US006743068B2

(12) United States Patent
Kosugi et al.

(10) Patent No.: US 6,743,068 B2
(45) Date of Patent: Jun. 1, 2004

(54) DESORPTION PROCESSING FOR FLAT PANEL DISPLAY

(75) Inventors: Tomoo Kosugi, San Jose, CA (US); John D. Porter, Berkeley, CA (US)

(73) Assignees: Sony Corporation (JP); Sony Electronics, Inc., Park Ridge, NJ (US)

( * ) Notice: Subject to any disclaimer, the term of this patent is extended or adjusted under 35 U.S.C. 154(b) by 89 days.

(21) Appl. No.: 09/823,744

(22) Filed: Mar. 31, 2001

(65) Prior Publication Data

US 2002/0142698 A1 Oct. 3, 2002

(51) Int. Cl.[7] ..... H01J 9/26
(52) U.S. Cl. ..... 445/25; 445/23; 445/24
(58) Field of Search ..... 445/23, 24, 25, 445/6

(56) References Cited

U.S. PATENT DOCUMENTS 4,320,418 A * 3/1982 Pavliscak ..... 313/584
5,772,485 A * 6/1998 Jeng et al. ..... 252/188.25
5,912,531 A * 6/1999 Hasegawa et al. ..... 313/309
5,959,400 A * 9/1999 Niigaki et al. ..... 313/336
6,017,257 A * 1/2000 Potter ..... 445/24
6,313,571 B1 * 11/2001 Hasegawa et al. ..... 313/306
6,380,670 B1 * 4/2002 Haven et al. ..... 313/495
6,409,564 B1 * 6/2002 Browning et al. ..... 445/24
6,409,566 B1 * 6/2002 Hasegawa et al. ..... 313/306

* cited by examiner

*Primary Examiner*—Gary F. Paumen
*Assistant Examiner*—Edwin A. Leon
(74) *Attorney, Agent, or Firm*—Rader, Fishman & Grauer PLLC; Ronald P. Kananen

(57) ABSTRACT

By desorption processing of a flat panel display in a vacuum before hermetic sealing, it is possible to reduce operational outgassing. The first embodiment involves plasma scrubbing, the second embodiment involves electron irradiation pre-aging, and the third embodiment involves electron irradiation pre-aging of the faceplate in an evacuation process.

5 Claims, 3 Drawing Sheets

DESORPTION PROCESSING FOR FLAT PANEL DISPLAY

TECHNICAL FIELD

The present invention relates generally to flat panel displays and more particularly to solving outgassing problems with flat panel displays.

BACKGROUND ART

Cathode-ray tube (CRT) displays have been the predominant display technology for purposes such as home television and computer systems. For many applications, CRTs have advantages in terms of superior color resolution, high contrast and brightness, wide viewing angles, fast response times, and low manufacturing costs. However, CRTs also have major drawbacks such as excessive bulk and weight, fragility, high power and voltage requirements, strong electromagnetic emissions, the need for implosion and x-ray protection, undesirable analog device characteristics, and a requirement for an unsupported low internal pressure envelope that limits screen size.

To address the inherent drawbacks of CRTs, alternative display technologies have been developed. These technologies generally provide flat panel displays, and include liquid crystal displays (LCDs), both passive and active matrix, electroluminescent displays (ELDs), plasma display panels (PDPs), vacuum fluorescent displays (VFDs) and field emission displays (FEDs).

The FED offers great promise as an alternative flat panel display technology. Its advantages include low cost of manufacturing as well as the superior optical characteristics generally associated with the CRT display technology. Like CRTs, FEDs are phosphor based and rely on cathodoluminescence as a principle of operation. FEDs rely on electric field or voltage induced electron emissions to excite the phosphors by electron bombardment rather than the temperature induced electron emissions used in CRTs. To produce these emissions, FEDs have generally used row-and-column addressable cold cathode emitters of which there are a variety of designs, such as point emitters (also called cone, microtip, or "Spindt" emitters), wedge emitters, thin film amorphic diamond emitters, and thin film edge emitters.

Each of the FED emitters is typically a miniature electron gun of micron dimensions formed into the baseplate of the FED. A faceplate is merged with the baseplate and hermetically sealed so the FED will operate at a low internal pressure. The inside of the faceplate is coated with phosphors and a thin film of metal. When a sufficient voltage is applied between the emitter and an adjacent gate, electrons are emitted from the emitter over a relatively wide area. A focus plate focuses the electrons within a picture element, or pixel. The emitters are biased as cathodes and the thin film of metal is biased as an anode, which causes the emitted electrons to be attracted and accelerated to strike the phosphors on the faceplate. The phosphors then emit visible light, which form the pixels making up the image on the viewing surface of the FED.

Electron emissions in FEDs require a low internal pressure and that they be contaminant-free to avoid serious problems, such as pressure degradation, emission current degradation, and/or plasma generation or ionization which can lead to non-uniform brightness of the display, decrease display efficiency, and/or shortening of the working life of the display.

Many different approaches have been tried to maintain the low internal pressure and contaminant-free condition.

In one approach, the FED is hermetically sealed in air and then evacuated through a tube, which is pinched or melted shut after evacuation in a process called "tipoff". To assist in the evacuation process and to maintain the low internal pressure, a "gettering material" is used which absorbs contaminant gasses by various chemical reactions. The gettering material is deposited in a portion of the tube between the flat panel display and the pinch or melt point of the tipoff process. This process has the disadvantage of the tube being subject to breakage during the handling, which accompanies manufacturing.

Another approach is forming a getter at a location along the interior surface of a baseplate or/and faceplate. This is disadvantageous because a getter typically needs a substantial amount of surface area to perform the gas collection function and this approach significantly reduces the active-to-overall area ratio. In addition, the active components of the FED easily become contaminated during the gettering material deposition process and some of the active FED components could become short-circuited.

A still further approach uses a pre-fabricated getter unit placed closer to the actual display elements than gettering material in the tube but further than the getting material in the display area. Unfortunately, the pre-fabricated getter takes up room beside the FED.

For flat panel displays with these gettering systems, it has been determined that certain gasses remain and are difficult to remove by the gettering system even after long periods of time. Knowing that the contaminant gasses cause severe problems, those skilled in the art have long sought a system by which the gettering effect could be improved, but they have been unsuccessful.

DISCLOSURE OF THE INVENTION

The present invention provides a method for reducing operational outgassing of contaminant gasses in a flat panel display having a cathode carrying baseplate hermetically sealed to an anode-coated, phosphor-bearing, faceplate with a low internal pressure between the baseplate and the faceplate. It has been discovered that a great deal of the operational outgassing occurs during the first few hours of operation. By desorption processing of the flat panel display in a vacuum before hermetic sealing, it is possible to reduce operational outgassing. Without being limiting, three embodiments of the desorption processing are disclosed. The first involves plasma scrubbing, the second involves electron irradiation pre-aging, and the third involves electron irradiation pre-aging of the faceplate in an evacuation process. This desorption processing extends the life of the FED by an unexpected factor of at least two times.

The above and additional advantages of the present invention will become apparent to those skilled in the art from a reading of the following detailed description when taken in conjunction with the accompanying drawings.

BEST MODE FOR CARRYING OUT THE INVENTION

Figure 1:
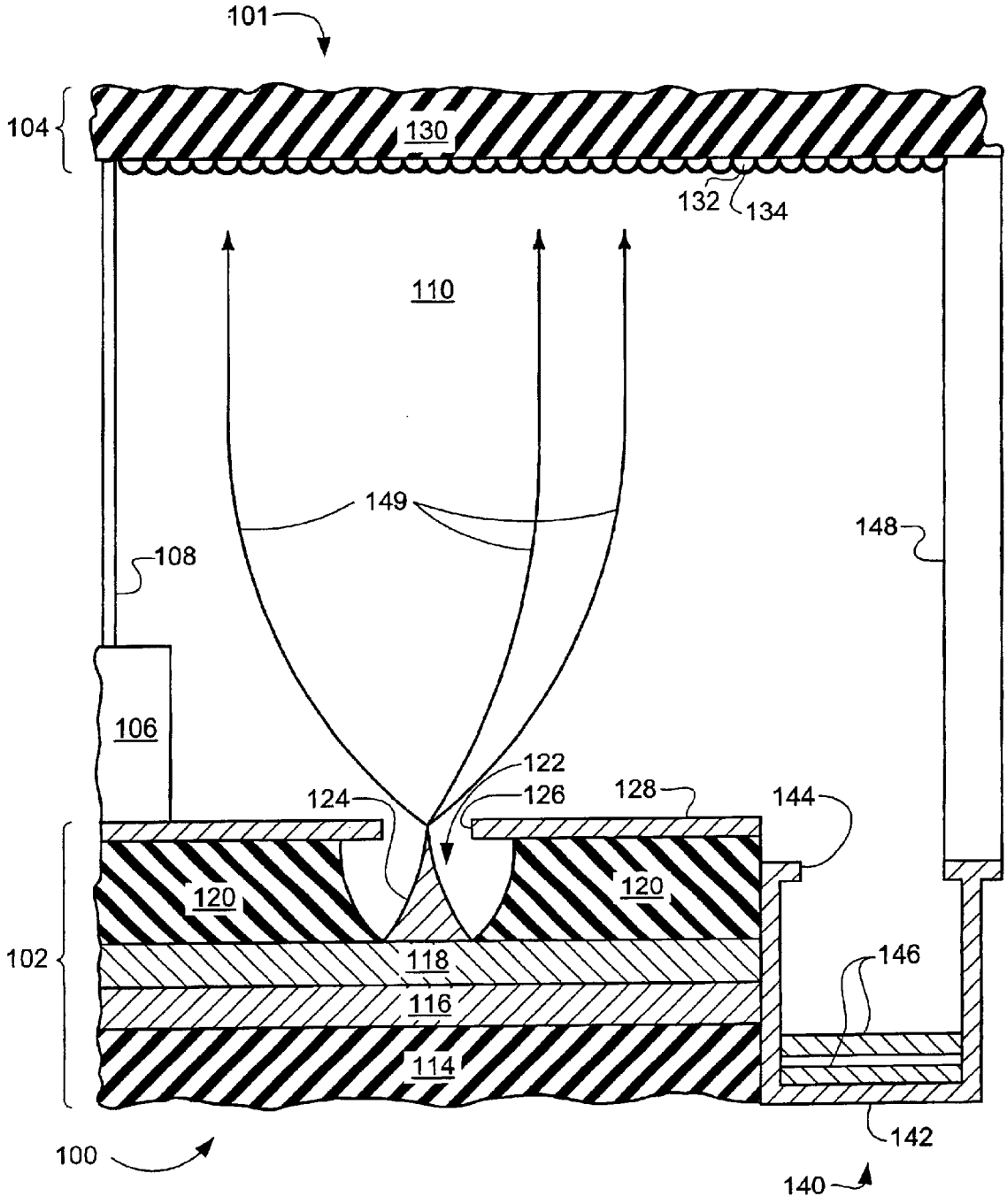
FIG. 1 (PRIOR ART)
FIG. 1 (PRIOR ART) is a close-up cross section of a field emission display for a single picture element.

Referring now to FIG. 1 (PRIOR ART), therein is shown a close-up cross section of a portion of a flat panel display, such as a field emission display (FED) 100 for a single picture element, or pixel 101. The FED 100 includes a baseplate 102 and a faceplate 104 separated by a focus plate 106 and a wall spacer 108 and surrounded by a hermetic seal 148. The space between the baseplate 102 and the faceplate 104 is a vacuum 110 of about $10^{-7}$ torr containing traces of contaminant gasses (not shown).

The baseplate 102 includes an insulating plate 114 upon which a base electrode, or conductive "row" electrode 116, has been deposited. A resistive layer 118 is deposited on the conductive row electrode 116 and is covered by an insulating layer 120 which has a cavity 122 formed therein. Inside the cavity 122 is an electron emissive element such as an emitter 124. The emitter 124 is deposited on the resistive layer 118 in the cavity 122 and is concentric with holes 126 patterned into an upper base electrode or conductive column electrode of which a portion is designated as a gate electrode 128. The gate electrode 128 is deposited over the insulating layer 120 and is connected to a column electrode (not shown).

The faceplate 104 includes a transparent plate 130 of a material, such as glass or plastic, coated with phosphors 132 having a thin electrode 134 of a material such as aluminum deposited on the phosphors 132.

A gettering system 140 is positioned adjacent the baseplate 102. Those skilled in the art would understand that the gettering system could be in any position, and could be of any configuration. The gettering system 140 includes a housing 142 having an opening 144 connected to the vacuum 110. Gettering material 146 is disposed in the housing 142. Examples of gettering materials are aluminum (Al), barium (Ba), cobalt (Co), chromium (Cr), iron (Fe), manganese (Mn), nickel (Ni), tantalum (Ta), titanium (Ti), vanadium (V), tungsten (W), combinations thereof, and compounds thereof.

In operation, the baseplate 102 is charged to become the cathode and the faceplate 104 is charged to become the anode. More specifically, a negative voltage is imposed on the conductive row electrode 116. The negative voltage is imposed through the resistive layer 118 to the emitter 124. A positive voltage is imposed on the thin electrode 134. When a suitable voltage, generally around 10 volts more positive than the voltage on the emitter 124, is applied to the gate electrode 128, the emitter 124 emits electrons into the vacuum 110 at various angles. The emitted electrons, under the influence of electric fields from the focus plate 106, follow parabolic trajectories indicated by the lines 149 to impact on the thin electrode 134, which has the anode voltage impressed upon it. The phosphors 132 behind the thin electrode 134 struck by the emitted electrons will produce light of a color consistent with a particular phosphor selected. The light will be for one picture element, or the pixel 101.

Figure 2:
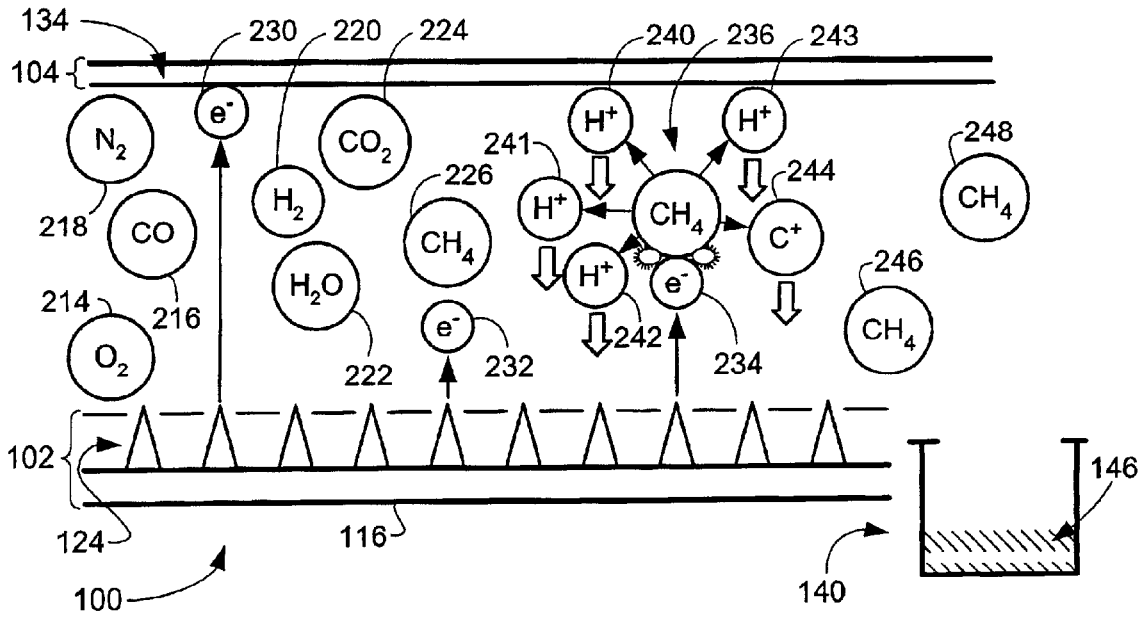
FIG. 2 (PRIOR ART)
FIG. 2 (PRIOR ART) is a schematic cross section of a field emission display outgassing during operation.

Referring now to FIG. 2 (PRIOR ART), therein is shown a schematic of the FED 100 with the baseplate 102, the faceplate 104, the emitters 124, the gettering system 140, and the gettering material 146. Between the baseplate 102 and the faceplate 104 are shown various contaminant gasses, which remain after the low internal pressure of the vacuum 110 is formed. Representative gasses are oxygen ($O_2$) 214, carbon monoxide (CO) 216, nitrogen ($N_2$) 218, hydrogen ($H_2$) 220, vaporous water ($H_2O$) 222, carbon dioxide ($CO_2$) 224, and methane ($CH_4$) 226.

Also shown are electrons 230, 232, and 234 being emitted from the emitters 124. The electron 230 is shown striking the thin electrode 134 on the faceplate 104. The electron 232 is shown striking the $CH_4$ molecule 226. The electron 234 is shown striking and breaking a $CH_4$ molecule 236 into hydrogen ions ($H^+$) 240–243 and a carbon ($C^+$) ion 244. The $H^+$ ions 240–243 and the $C^+$ ion 244 have positive charges and are attracted towards the negatively charged, cathode, or the baseplate 102 as indicated by the wide arrows. After accumulating near the baseplate 102, the ions will recombine to form a $CH_4$ molecule 246. A $CH_4$ molecule 248 indicates that recombined molecules having a neutral charge will again enter the vacuum 110 to cause various previously enumerated problems. Due to its neutral charge, the $CH_4$ molecule 248 may or may not enter the gettering system 140 since it will move randomly.

Figure 3:
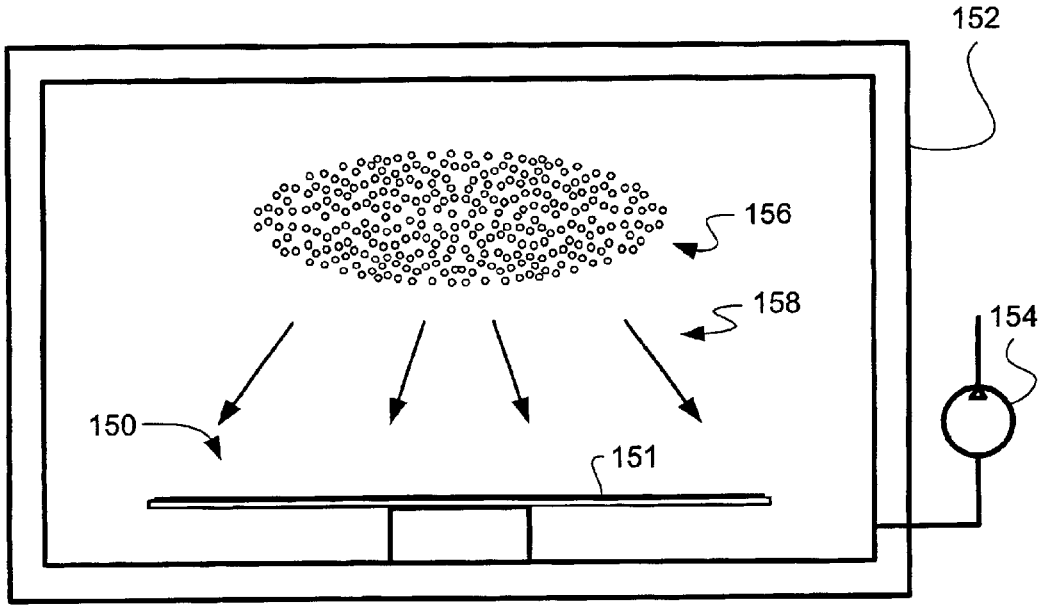
FIG. 3 is a schematic cross section of a field emission display being aged in a vacuum chamber in accordance with the present invention.

Referring now to FIG. 3, therein is shown a schematic cross section of a faceplate 150 of a flat panel display being subject to desorption processing to accelerate gassing in a plasma sputter chamber 152 in accordance with a first embodiment of the present invention. The plasma sputter chamber 152 is capable of being evacuated by a vacuum pump 154.

The manufacturing process in which the present invention is incorporated begins with the faceplate 150 being disposed in the plasma sputter chamber 152 with the phosphors 151 exposed. The plasma sputter chamber 152 is pumped down to about $10^{-7}$ to $10^{-8}$ torr and a plasma 156 of low atomic weight gasses, such as hydrogen or helium, is formed. The faceplate 150 is then scrubbed by plasma sputtering of ions or electrons 158 by being subjected to a respective voltage of −10 to −1000 V or +10 to 1000 V for about 1 to 60 minutes.

After scrubbing, the faceplate 150 and a baseplate (not shown) are merged and then sealed together. The space between the faceplate 150 and the baseplate is then evacuated to operating vacuum and the evacuation tube is sealed.

Figure 4:
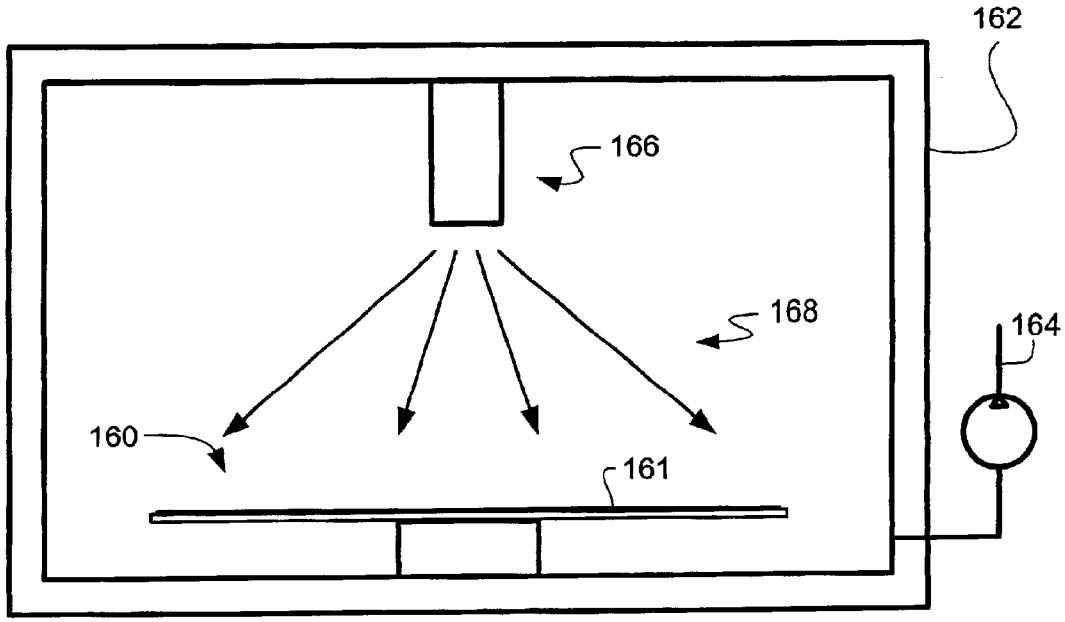
FIG. 4 is a schematic cross section of a faceplate being aged in a vacuum chamber having a cathode in accordance with the present invention.

Referring now to FIG. 4, therein is shown a schematic cross section of a faceplate 160 of a flat panel display being subject to desorption processing to accelerate outgassing in a vacuum chamber 162 in accordance with a second embodiment of the present invention. The vacuum chamber 162 is capable of being evacuated by a vacuum pump 164.

The manufacturing process in which the present invention is incorporated begins with the faceplate 160 being disposed in the vacuum chamber 162 with the phosphors 161 exposed. The vacuum chamber 162 is pumped down to about $10^{-7}$ to $10^{-8}$ torr and an electron gun 166 emits electrons 168. The faceplate 160 is held at a voltage of around 7 kV and is then pre-aged by irradiation with the electrons 168 having a current density of 5 to 10 times higher than that of normal operation of the faceplate 160 for about 120 to 300 minutes.

After pre-aging, the faceplate 160 and a baseplate (not shown) are merged while still in the vacuum, sealed together, and the evacuation tube sealed. Since the pre-aging, the merge, sealing, and sealing of the evacuation tube are all performed in a vacuum, a separate evacuation step is not required.

In a third embodiment (not shown) of the present invention, the normal manufacturing steps are used from merge of a faceplate and a baseplate, sealing, and then evacuation. However, during evacuation and before sealing of the evacuation tube, the faceplate is pre-aged to accelerate gassing by application of a voltage of 6 to 9 kV between the faceplate and baseplate for about 120 to 300 minutes. After pre-aging under evacuation at $10^{-7}$ to $10^{-8}$ torr, the evacuation tube is sealed.

It has been discovered that desorption processing as disclosed herein will extend the life of a FED by an unexpected factor of at least two times.

While the invention has been described in conjunction with a specific best mode, it is to be understood that many alternatives, modifications, and variations will be apparent to those skilled in the art in light of the aforegoing description. Accordingly, it is intended to embrace all such alternatives, modifications, and variations which fall within the spirit and scope of the included claims. All matters hither-to-fore set forth herein or shown in the accompanying drawings are to be interpreted in an illustrative and non-limiting sense.

The invention claimed is:

1. A method for manufacturing a flat panel display comprising the steps of:

providing a baseplate and a faceplate;

desorption processing the faceplate in a vacuum;

merging the baseplate and the faceplate while still in the vacuum after the step of desorption processing the faceplate; and sealing the vacuum between the baseplate and the faceplate;

wherein the step of desorption processing includes a step of pre-aging the faceplate;

wherein the step of pre-aging the faceplate is performed from 120 to 300 minutes; and wherein the step of desorption processing includes a step of pre-aging before merge of the baseplate and the faceplate.

2. The method as claimed in claim 1 wherein the step of pre-aging uses irradiation with electrons from an electron gun.

3. The method as claimed in claim 2 wherein the step of pre-aging uses irradiation with electrons having a current density of 5 to 10 times higher than that of the faceplate during normal operation.

4. A method for manufacturing a flat panel display comprising the steps of:

providing a baseplate and a faceplate;

desorption processing the faceplate in a vacuum;

merging the baseplate and the faceplate; and sealing the vacuum between the baseplate and the faceplate;

wherein the step of desorption processing includes a step of pre-aging after merge of the baseplate and the faceplate.

5. The method as claimed in claim 4 wherein the step of pre-aging includes application of a voltage of 6 to 9 kV between the baseplate and the faceplate.

* * * * *

UNITED STATES PATENT AND TRADEMARK OFFICE

CERTIFICATE OF CORRECTION

PATENT NO. : 6,743,068 B2
DATED : June 1, 2004
INVENTOR(S) : Tomoo Kosugi et al.

It is certified that error appears in the above-identified patent and that said Letters Patent is hereby corrected as shown below:

Title page,
Item [73], Assignee, should read:
-- Sony Corporation (Tokyo, JP); Sony Electronics Inc., Park Ridge, NJ (US); Candescent Technologies Corporation, San Jose, CA (US) --.

Signed and Sealed this

Twenty-first Day of March, 2006

JON W. DUDAS
*Director of the United States Patent and Trademark Office*